US005601690A

United States Patent [19]

Gauld et al.

[11] Patent Number: 5,601,690

[45] Date of Patent: Feb. 11, 1997

[54] METHOD FOR SCREENING PULP

[75] Inventors: W. Thomas Gauld, Mobile; Ronald Visser, Theodore; Arthur V. Jepsen, Mobile, all of Ala.

[73] Assignee: Gauld Equipment Company, Theodore, Ala.

[21] Appl. No.: 273,467

[22] Filed: Jul. 11, 1994

[51] Int. Cl.[6] ..... D21C 9/08; B07B 1/22

[52] U.S. Cl. ..... 162/55; 162/58; 209/240; 209/234; 209/273

[58] Field of Search ..... 162/55, 57, 58, 162/232, 254, 261; 209/234, 268, 270, 273, 281, 284, 300, 240; 241/89.2, 89.1, 89.3, 80, 91, 79.2, 79.3, 261.1, 259.2, 86, 86.2; 210/415

[56] References Cited

U.S. PATENT DOCUMENTS

| | | | |
|---|---|---|---|
| 3,656,528 | 4/1972 | Mencacci | 241/86 |
| 3,664,501 | 5/1972 | Cowan | 209/273 |
| 3,814,244 | 6/1974 | Young | 209/270 |
| 3,939,065 | 2/1976 | Einarsson Alhfors | 209/240 |
| 4,234,417 | 11/1980 | Gauld et al. | 209/306 |
| 4,267,035 | 5/1981 | Martin | 209/273 |
| 4,374,728 | 2/1983 | Gauld | 209/273 |
| 4,462,901 | 7/1984 | Gauld | 209/234 |
| 4,605,173 | 8/1986 | Edmonds | 241/36 |
| 4,744,894 | 5/1988 | Gauld | 209/234 |
| 4,754,935 | 7/1988 | Gullichesen | 241/24 |
| 4,819,881 | 4/1989 | Sepke | 241/88.1 |
| 4,907,750 | 3/1990 | Seifert | 241/73 |
| 4,943,347 | 7/1990 | Floden | 162/61 |
| 4,955,549 | 9/1990 | Reinhall | 241/80 |
| 4,968,417 | 11/1990 | Ahs | 209/273 |
| 4,986,480 | 1/1991 | Gullichsen et al. | 241/28 |
| 5,061,370 | 10/1991 | Ferland et al. | 210/194 |
| 5,282,579 | 2/1994 | Poser et al. | 241/69 |
| 5,358,637 | 10/1994 | Hutzler et al. | 210/415 |

OTHER PUBLICATIONS

"Stock Preparation," *Hanbook of Pulp and Paper Technology*, pp. 305–307, (date unknown).

*Primary Examiner*—Donald E. Czaja
*Assistant Examiner*—Jose A. Fortuna
*Attorney, Agent, or Firm*—Needle & Rosenberg, P.C.

[57] ABSTRACT

A method for screening fibrous stock slurry having a rotor impeller and a screen, in which accepts quality and throughput may be adjusted without stopping the screening process by relative displacement of the clearance between the rotor and the screen plate. In one version, this relative displacement is accomplished by axial displacement of frustoconical portions of the bladed rotor and screen. The relative axial displacement changes the degree of pulp disturbance in a primary screening zone, thus causing throughput and accepts quality to change accordingly. The primary screening zone may be between the rotor impeller and the screen, or it may be on the other side of the screen, in which case the blades on the screen are designed to permit a portion of the pulp slurry to flow through the screen into a region between the rotor impeller and the screen. Axial displacement may also be used to effect an adjustable clearance between a planar screen and a planar rotor impeller or between a rotor having an inclined surface for slidable blades and a cylindrical screen.

7 Claims, 6 Drawing Sheets

516
550
532
514
515

534
538
552
536
518
540

110
100
102
104
106
108
103
105
130
531
530
522
118
120
517
520
528
116
510
512
A
B
C
153
13
526
83
24
81
524

METHOD FOR SCREENING PULP

FIELD OF THE INVENTION

This invention relates to screens intended for use in the paper industry and in related applications for screening debris from pulp and for debris removal and/or particle size classification and/or liquid/solid separation in various slurries in other processes, and more particularly to processes and methods of changing the particle speed distribution of particles in a slurry between a rotor and a screen.

DESCRIPTION OF THE RELATED ART

A number of prior art fibrous stock screening devices are known. Gauld et al., U.S. Pat. No. 4,234,417, discloses a fibrous stock screening apparatus including a rotor having a cylindrical body member and a plurality of blade members attached to the body member with the leading edge of each blade member spaced farther from the body member than the trailing edge thereof. Gauld, U.S. Pat. No. 4,374,728, discloses a fibrous stock screening apparatus including means for allowing untreated stock to be added at points deep within the screening zone thereof to maintain a proper water to fiber ratio throughout the screening zone. Gauld, U.S. Pat. No. 4,462,901 discloses a fibrous stock screening apparatus including a preliminary screen and a secondary screen for providing a course screening step and a fine screening step. Gauld, U.S. Pat. No. 4,744,894, discloses a screen having a housing member having a substantially hollow interior, screen means located within the interior for dividing the interior into a screened zone and a screening zone, stock inlet means communicating with the screening zone, accepts outlet means communicating with the screened zone, and rotor means located at least partially within the interior for facilitating the passage of acceptable stock through the screen means. The disclosures of U.S. Pat. Nos. 4,234,417, 4,374,728, 4,462,901, and 4,744,894 are hereby incorporated by reference into the present disclosure. None of the above patents disclose or suggest the present invention.

SUMMARY OF THE INVENTION

The present invention is directed toward improving upon prior rotor and screen design in fibrous stock screening apparatus for separating various size debris or particles from a submerged pulp slurry.

To adjust throughput rate and accept quality in prior art screens, it is necessary to stop production, open up the screen, and adjust threaded rods, replace varying thicknesses of shims, or resort to other manual methods. These manual adjustment methods are inconvenient, cumbersome, and impractical on a continuous basis to control constantly varying requirements of either quality or capacity. Thus, it would be desirable to replace this method of adjustment with another method that does not require production to be stopped. Moreover, variable speed drives and downtime associated with replacing sheaves are relatively costly. It would therefore also be desirable to provide a method of adjustment that would permit readjustment of the apparatus to optimize performance as internal conditions change.

There is thus provided, according to one aspect of the invention, an apparatus for screening fibrous stock slurry comprising a rotor having a frusto-conical body rotatably and coaxially mounted within an open-ended, similarly frusto-conical screen. The screen is mounted in a hollow housing and has a multiplicity of apertures for allowing a portion of a fibrous stock introduced in the housing to pass through. The rotor is provided with a plurality of blade members attached to its outer surface and spaced substantially evenly about the circumference of the body member and radiating outwardly therefrom. Each blade member has a leading edge and a trailing edge, with the former spaced farther from the body member than the latter. There is also provided a means for adjusting the relative positions of the frusto-conical body of the rotor and the frusto-conical screen by moving either the body of the rotor, the screen, or both, relative to one another along their common axis. Because of the tapered shapes of the frusto-conical body and the frusto-conical screen, such motion has the effect of adjusting the clearance between the rotor body and the screen, thereby permitting throughput rate and accept quality to be adjusted while the screen is in operation.

According to another aspect of the invention, a method for adjusting throughput rate and accept quality of a screening apparatus for screening debris from pulp is provided that comprises the steps of (a) introducing a fibrous stock into the housing of an apparatus between a frusto-conical body member having a plurality of blade members attached thereto and a frusto-conical screen basket, and (b) while rotating the body member relative to the screen basket, adjusting the relative axial positions of the body member and the screen basket to adjust the clearance therebetween.

According to another aspect of the invention, pulp slurry can alternately be introduced to the outside of the screen basket. In this aspect of the invention, rotor blades acting as hydrofoils pull fibers from the outside of the screen basket to the inside, with the negative pulse portion of the foils. The degree or extent of the negative pulse provided by the hydrofoils and be readily influenced by adjustment of the clearance between the rotor blades and the basket. According to this aspect of the invention, the rotor blades are rotating in the accepts slurry, and thus are protected from wear or damage because the debris stays on the outside of the basket.

The above apparatus and method further allows better use of the available power, because the power can be fine-tuned, along with the clearance between the body member and the screen basket, for various slurry types and conditions. Also, screen basket inventory can be reduced because worn basket life can be extended by adjusting clearances, and because the adjustable clearance permits a single screen basket to imitate baskets having larger or smaller holes. Rotor blade life can also be extended by clearance adjustments.

According to another aspect of the invention, the quality and throughput of a screening apparatus can be monitored and controlled while the screening apparatus is in operation a process comprising the steps of (a) continuously introducing a pulp slurry into a primary screening zone between a bladed rotor and a screen;

(b) operating the rotor to generate regions of positive and negative pressure in the pulp slurry within the primary screening zone, so that a portion of the slurry passes through apertures in the screen, thereby becoming the accepts portion;

(c) testing the accepts portion to determine at least one parameter from the group consisting of accepts throughput rate, accepts dirt content, accepts debris content, and combinations thereof; and (d) while continuing to introduce pulp slurry into the primary screening zone, adjusting the clearance between the bladed rotor and the screen to adjust the accepts portion parameter into a predetermined range.

According to yet another aspect of the invention, the quality and throughput of a screening apparatus can be adjusted while the apparatus is in operation by a process consisting of the steps of:

(a) continuously introducing a pulp slurry into a zone on a first side of a screen;

(b) introducing a fluid on a second side of the screen opposite the first side between the second side of the screen and a bladed rotor;

(c) operating the rotor so that the blades operate in a manner similar to hydrofoils to draw a portion of the slurry into through apertures in the screen into the region between the second side of the screen and the bladed rotor, the portion of the slurry drawn in thereby becoming the accepts portion;

(d) monitoring the feed, accepts, or rejects accepts portion to determine at least one parameter from the group consisting of accepts throughput rate, accepts dirt content, accepts debris content, reject rate, reject concentration, feed rate, debris level in feed, and combinations thereof; and (e) while continuing to introduce pulp slurry into the zone on the first side of the screen, adjusting the clearance between the bladed rotor and the screen to adjust the monitored parameter into a predetermined range.

Thus, it is an object of the invention to provide an apparatus and a method for optimizing throughput rate and accept quality without the need to stop the screen to dismantle and reset components.

It is a further object of the invention to better use available power to fine-tune the screening process for various slurry types.

It is a still further object of the invention to provide a screening apparatus and method that reduces costs and extends the life of screen components.

These and other objects of the invention will become apparent to one skilled in the art upon reading the detailed description of the invention that follows below.

DETAILED DESCRIPTION OF THE INVENTION

Figure 1:
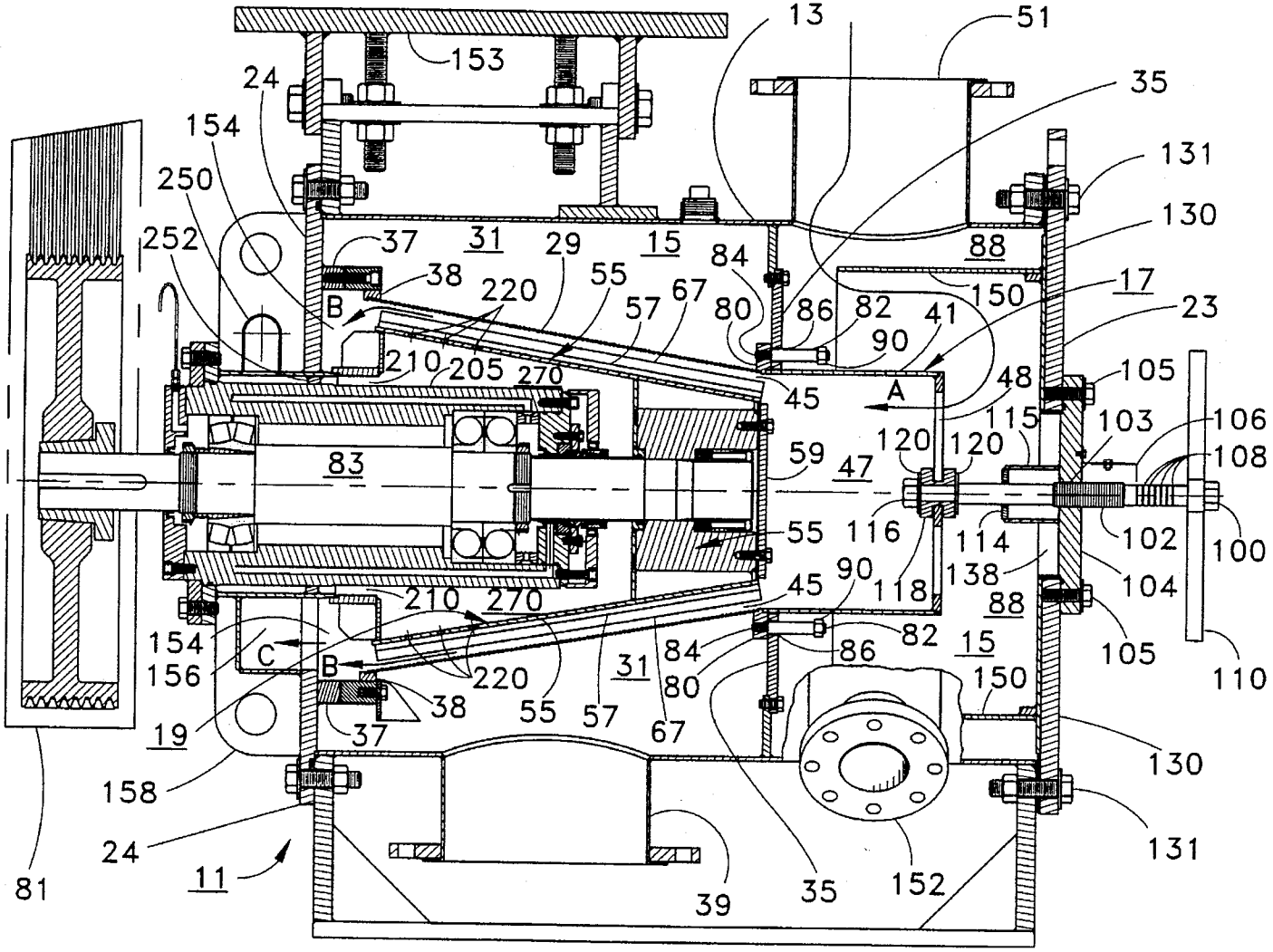
FIG. 1 is a side sectional view of a fibrous stock slurry screening apparatus in accordance with the invention in which fibrous stock slurry is introduced into a primary screening zone from the rear of a screen means and in which the rotor rotates in a fixed axial position and the screen is moved axially to adjust clearance between blades on the rotor and the screen.

The fibrous stock screening apparatus 11 of the present invention, illustrated in FIG. 1, is used in separating various sized debris from a submerged pulp slurry. An explanation of the novel sections of the screening apparatus 11, along with an abbreviated explanation of the conventional portions sufficient to permit an understanding of the novel features follows. A better understanding of the conventional portions of the design may be obtained by reference to the above-mentioned prior art references, and particularly U.S. Pat. No. 4,744,894.

Apparatus 11 includes a housing member 13 having a substantially hollow interior 15, a screen means 17 located within the substantially hollow interior 15, and a rotor means 19 located within the interior. The screen means 17 includes a frusto-conical screen member 29, which has apertures for screening, mounted within substantially hollow interior 15 for dividing the interior into a screened zone 31 and a screening zone, and for allowing acceptable stock to pass from the screening zone into the screened zone 31. An accepts outlet means or port 39 is provided for communicating with the screened zone 31 for allowing acceptable stock which passes through the frusto-conical screen member 29 into the screened zone 31 to exit the interior 15 therethrough. Screen means 17 also includes an extended portion 41, which is preferably cylindrical in shape rather than frusto-conical, and need not, in this embodiment, be provided with apertures for screening. Extended portion 41 extends past a first coupling means 35 (which is fixedly and stationarily attached to housing member 13) towards a first end 23 of housing member 13. First coupling means 35 slidingly and sealingly surrounds the cylindrical extended portion 41 of screen means 17, effectively separating slurry entry region 88 in the interior 15 of housing member 13 from screened zone 31. A mounting ring 80 is preferably provided around screen means 17 to engage first coupling means 35 in such a manner as to provide a limit to the axial sliding motion of screen means 17. The sliding engagement may be enhanced by other means, such as guide pins 82 slidingly and slidingly engaged in holes 86 in coupling means 35 and threaded through holes 84 in mounting ring 80. Limit stops for the axial sliding motion of screen means 17 may thus be provided by the mounting ring 80 in one direction, and by heads 90 on guide pins 82 in the other direction. Preferably, mounting ring 80 is located where cylindrical extended portion 41 of screen means 17 meets screening member 29. Frusto-conical screen member 29 is also provided with a sliding engagement means 38, which slidingly and sealingly engages a structure 37 fixedly mounted on a second end 24 of housing member 13. Structure 37 is an annular structure which also cooperates with sliding engagement means 38 to separate screened zone 31 from reject zone 154. Reject zone 154 is in fluid communication with a reject cavity 156 in supporting gusset 158 which in turn is in fluid communication with a port for a rejected portion of a slurry; i.e., that portion that does not make it through apertures in frusto-conical screen member 29. Reject zone 154 is an annular chamber bounded on the inner circumference by the rotor means 19 and on the outer circumference by the sliding engagement means 38 (i.e., the seating ring) of the screen means 17. An opening leads from reject zone 154 to reject cavity 156 in supporting gusset 158, and to an outlet (not shown in FIG. 1).

Rotor means 19 is provided to contribute to the screening efficiency. Rotor means 19 preferably includes a rotor body member 55 located coaxially within the interior of frusto-conical screen member 29. The body member 55 includes a frusto-conical wall 57. A primary screening zone 45 is thus defined between frusto-conical wall 57 of rotor body member 55 and frusto-conical screen member 29. Rotor means 19 is provided with a conventional drive means 81, which confers rotational motion along a longitudinal axis 27 common to both screen means 17 and rotor body member 55 by means of a conventional shaft and bearing assembly 83. Internal end 59 of rotor means 19 is closed and is fixedly attached to the shaft and bearing assembly 83. A motor to drive the drive means 81 may be placed on platform 153 which is Atop housing member 13.

Rotor means 19 preferably includes a plurality of blade members 67 attached to and spaced substantially evenly about the outer perimeter of body member 55. The blade members are arranged to allow a slight distance between the blade members 67 and screen member 29 to permit a layer of stock to be formed therebetween to allow proper screening to occur. The blade members may be of various cross-sectional shapes, as will be understood by those skilled in the art, and may generally be similar to the blade members of U.S. Pat. No. 4,744,894, except for their arrangement on a frusto-conical body member 55 rather than a cylindrical body member. The distance between the blade members 67 and the screen member 29 is adjustable by inventive means to be described below.

Figure 2B:
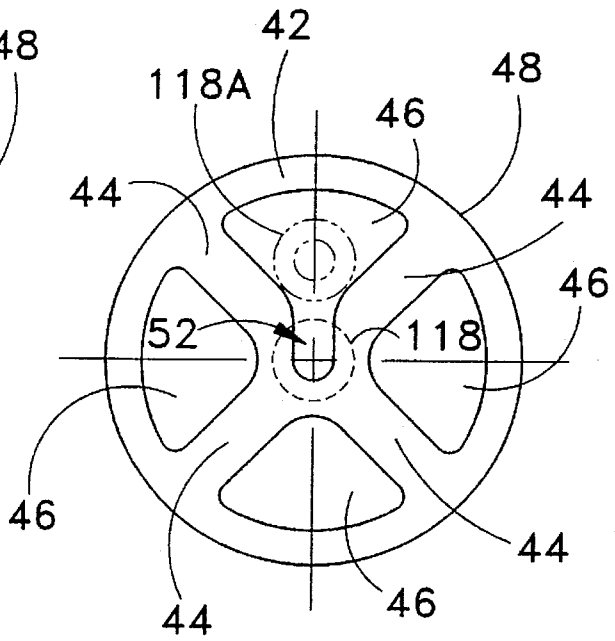
FIG. 2B is an end view of the screen means shown in FIG. 2A, showing, in phantom detail, a portion of the engagement means of an adjustment screw.
Figure 2A:
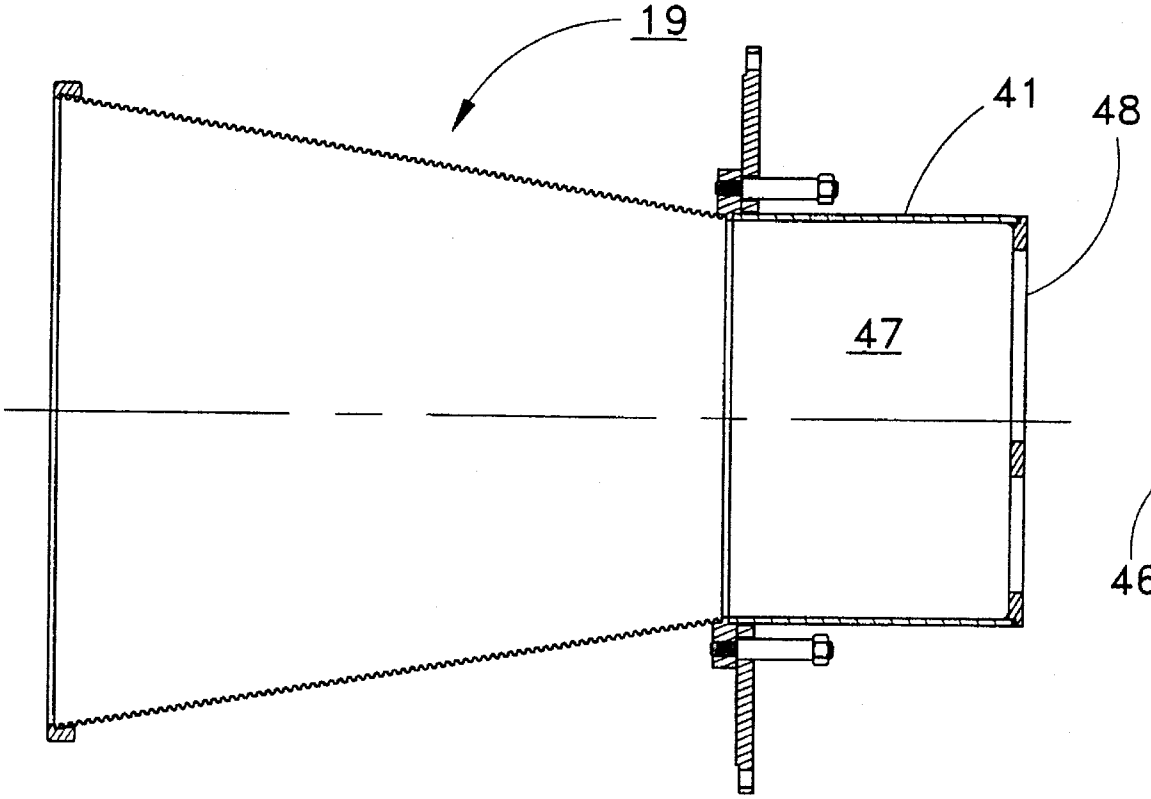
FIG. 2A is a side sectional view of the screen means and a portion of the screen mounting means shown in FIG. 1.

Fibrous stock or slurry is introduced into slurry entry region 88 of substantially hollow interior 15 through stock inlet means 51. Stock or slurry entering through stock inlet means 51 flows through slurry entry region 88 and into the hollow interior 47 of extended portion 41 through inlets disposed at the end 48 of extended portion 41. These inlets are better illustrated in FIGS. 2A and 2B, which show, respectively, a side cut-away view of rotor means 19 and an end view of the rotor means.

In a preferred embodiment of the invention, end 48 of extended portion 41 has a continuous, preferably circular rim 42. A number of preferably equiangularly spaced spokes 44 radiate from the center of end 48 to rim 42. Spokes 44 and rim 42 define a plurality of pie-shaped inlet regions 46 through which a pulp slurry can enter the hollow interior 47 of extended portion 41. One of the inlet regions 46 has a slot 52 extending from a central angle into the center of end 48 for accepting a thrust ring 118, shown in phantom outline in FIG. 2B. Thrust ring 118 is inserted into slot 52 by inserting it into the associated pie-shaped region 46, as indicated by phantom outline 118A. Thrust ring 118 may then be easily engaged in slot 52 by sliding it into position. It will be evident to those skilled in the art that many other configurations of end 48 of extended portion 41 will also provide a suitably engagable slot 52. (Another example of a suitable configuration is described below in connection with FIGS. 5A, 5B, and 5C.

Returning to FIG. 1, adjustment screw 100 is provided to facilitate adjustment of the screen to rotor clearance. Rotor clearance is adjusted by changing the axial displacement of screen assembly 17. End 23 of apparatus 11 is provided with an access door 130, which may be hinged to housing member 13, but which is fixedly attached to end 23 by conventional means 131 when apparatus 11 is in operation. Access door 130 has an opening 138 surrounding axis 27. Adjustment plate 104 is fixedly attached to access door 130 by conventional means 105. Adjustment plate 104 also has a threaded aperture 103 around axis 27 for accepting threads 102 of adjustment screw 100. Sealing means, such as assembly 115 and O-ring 114 are provided to sealingly engage adjustment screw so that slurry in initial screening zone 43 will not leak through adjustment plate 104. Thrust ring 118 is fixedly attached to an end of adjustment screw 100 by attachment means such as bolt 116 and washers 120. It will be recognized that adjustment plate 104 may be attached to access door 130 in a manner by which thrust ring 118 engages slot 52 (shown in FIG. 2), thus operatively engaging adjustment screw 100 with structure 47 so that an adjustable displacement of screen assembly 17 along axis 27 may be obtained by turning adjustment handle 110, while thrust ring 118 rotates in slot 52. Displacement is accommodated by the sliding, sealing fit of first coupling means 35 around extend portion 41 of screen means 17, of guide pins 82 through holes 86, and structure 37 and engagement means 38. Markings 108 on the shaft of adjustment screw 100, in cooperation with indicator 106 on adjustment plate 104, provide a visual indication of the relative axial movement of the screen assembly 17 with respect to the rotor 19. Rotor 19, in this embodiment, rotates, but is not displaced axially. Between this housing and the inside of rotor shell 55 is a dilution compartment 270. Dilution liquid is fed to this compartment through an annular opening 210 between a bearing housing 205, which is stationarily mounted on gusset 158, and the drive end frame 24. Dilution enters this opening from a dilution inlet pipe 250. To support this bearing housing 205 in the drive end frame 24, a number of chocks 252 are fitted around annular opening 210. Diluent enters the screening zone 45 from the dilution compartment 270 through a plurality of holes 220 in rotor shell 55. These holes are spaced in such a manner as to lie under a trailing edge of a rotor blade 67.

It will be readily appreciated that the clearance between frusto-conical screen section 29 and rotor blades 67 may readily be calculated from the displacement indicated by indicator 106, the relative angles of frusto-conical screen section 29 and rotor 55, and the dimensions of blades 67. It will further be appreciated that this angle may be increased or decreased by the movement of adjustment screw 100 during operation of the apparatus while the apparatus is in operation.

To use the inventive apparatus, a slurry is introduced into stock inlet means 51. The slurry passes into a region between a cylindrical door shroud 150, shown in cut-away section in FIG. 1, and extended portion 41 of screen means 17, and into hollow interior 47 of extended portion 41 as shown by arrow A. A port or trash trap 152 is provided for removal of heavy foreign items in the slurry, e.g., bolts, that would damage apparatus 11 if they entered primary screening zone 45. Slurry that enters hollow interior 47 of extended portion 41 drains towards primary screening zone 45. There, the rotational movement of rotor body member 55 moving the blade members 67 moves the slurry, causing a first screened portion (i.e., the "accepts") to pass through apertures in frusto-conical screen member 29. An improvement made possible by this invention is that the quality of the screening action may be controlled by adjusting the distance between the blade members 67 and frusto-conical screen member 29 as indicated above. Accepts enter screened zone 31, and are drained from accepts outlet means or port 39. Slurry material that does not pass through apertures in frusto-conical screen member 29 passes into reject zone 154, and into region 156 in gusset 158, as indicated by arrows B and C. From region 156, the rejected material may be drained or otherwise removed.

It will be readily appreciated that, of the pulp within primary screening zone 45, the pulp that is exiting through frusto-conical screen member 29 is at a minimum velocity—for example, approximately 5 ft./sec. On the other hand, the tip speed of blade members 67 may be, for example, approximately 65 ft./sec., thus creating zones of pressure around the blades. The form and extent of these disturbances as a function of time and space are determined by the shape of the blades, which may be, for example, simple square bars or complex hydrofoils—the invention works equally well with these and other shapes—thus, the selection of particular blade members 67 can be based upon the desired requirements for the particular application such as, for example, the nature of the particular fibrous slurry, the type of debris to be removed and the end product requirements, for the application.

It has been discovered that the substantial pulp speed gradients that exist within primary screening zone 45 depend upon the clearance between frusto-conical screen member 29 and blade members 67. For example, the gradient will substantially increase if the clearance decreases from a wide to a narrow gap. A surprising result in this invention is that, by adjusting the clearance between frusto-conical screen member 29 and blade members 67, and thus, changing conditions within primary screening zone 45, the quality and capacity of the screening process can be adjusted. Importantly, this adjustment may be made based upon continuous, periodic, or intermittent sampling of the accepts from the inventive embodiment described above without stopping the screening process.

Figure 3:
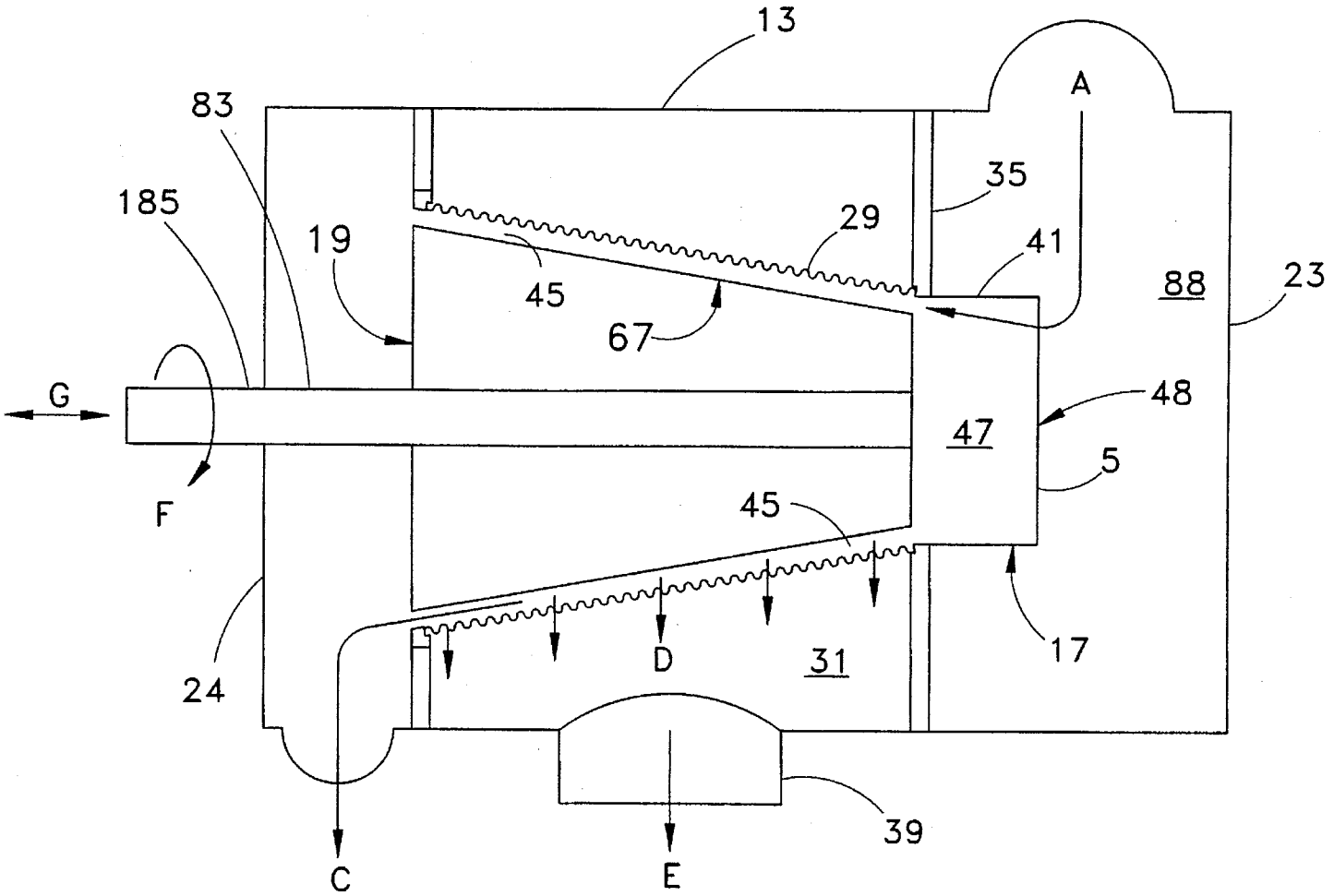
FIG. 3 is a side sectional view of a screening apparatus in accordance with the invention in which fibrous stock slurry is introduced into a primary screening zone from the rear of a screen means and in which the screen is fixed and the rotor is axially displaced to adjust clearance between the rotor and the screen.

It will be clear to those skilled in the art that one could axially displace rotor means 19 while maintaining screen means 17 stationary relative to housing member 13 to achieve the same or similar results, as shown in the simplified cross-sectional drawing of FIG. 3. Shaft and bearing assembly 83 may be adjusted axially as indicated by arrow G while rotating as indicated by arrow F, thus moving rotor means 19 relative to screen means 17. For example, a portion 185 of the shaft of the shaft and bearing assembly 83 outside of housing member 13 may be provided with cogs that engage a gear on a motor drive (not shown in FIG. 3.), thus allowing shaft and bearing assembly 83 to be axially displaced while remaining operatively engaged with the motor. Slurry enters slurry entry region 88 and hollow interior 47 of extended portion 41 as previously described and as shown by arrow A in FIG. 3, and is processed in primary screening zone 45. The adjustable axial motion changes the spacing between blade members 67 and frusto-conical screen member 29. Because this spacing controls the movement of and pressure gradients in the slurry within primary screening zone 45, the quality of accepts exiting through apertures in frusto-conical screen member 29 into screened zone 31, as indicated by arrows D, can be controlled. The accepts exit through accepts outlet means or port 39 as indicated by arrow E. Rejects exit as indicated by arrow C.

Figure 4:
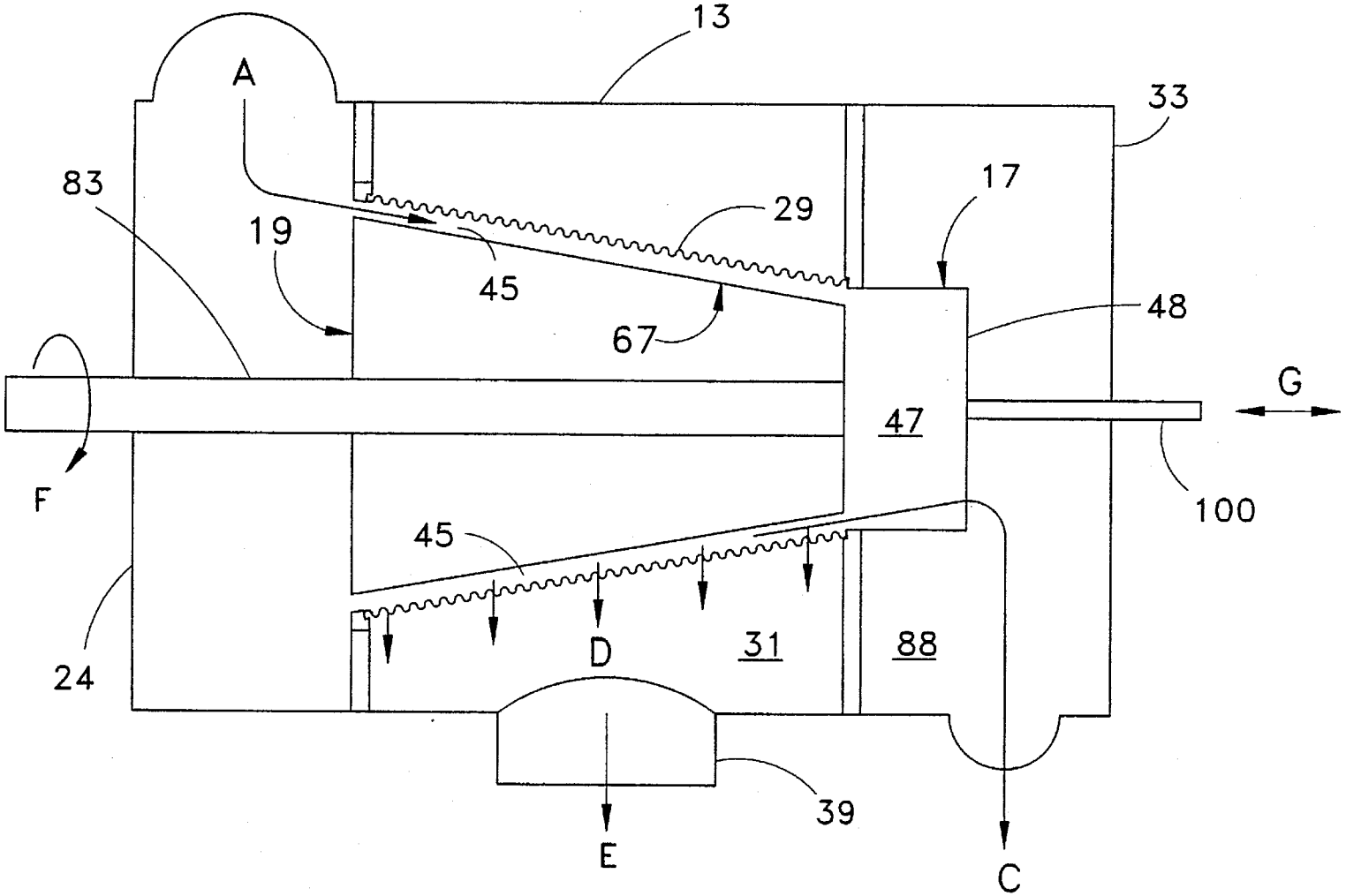
FIG. 4 is a side sectional view of a screening apparatus in accordance with the invention in which fibrous stock slurry is introduced into a primary screening zone from the front of the apparatus and in which the rotor rotates in a fixed axial position and the screen is axially displaced to adjust clearance between the rotor and the screen.

FIG. 4 is a simplified cross-sectional diagram of a screening device in accordance with the invention showing that slurry can also be provided in the front of the fibrous stock screening apparatus. In this particular illustration, screen means 17 is axially adjustable by means of an adjustment screw 100 or other means as indicated by arrow G, although rotor means 19 could alternately be adjusted, as in FIG. 3. In the fibrous stock screening apparatus of FIG. 4, slurry enters primary screening zone 45 through a front opening, as indicated by arrow A. Accepts are screened through apertures in frusto-conical screen member 29 as indicated by arrows D and exit through accepts outlet means or port 39, as indicated by arrow E. Region 88 in this embodiment becomes a slurry exit region, as indicated by the path of rejects shown by arrow C.

It will, of course, be understood by those skilled in the art that the embodiments illustrated in FIGS. 1–4 employ blade members 67 to move the fibrous stock in primary screening zone 45, and thus, it is the clearance between blade members 67 and frusto-conical screen member 29 that is critical to the screening quality of the apparatus. If a means other than blade members 67 are used to move the stock (e.g., grooves or other features in or on rotor body member 55), the clearance in primary screening zone 45 will, of course, be measured as the distance between frusto-conical screen member 29 and some other structure on rotor body member 55.

Figures 5A, 5B, 5C:
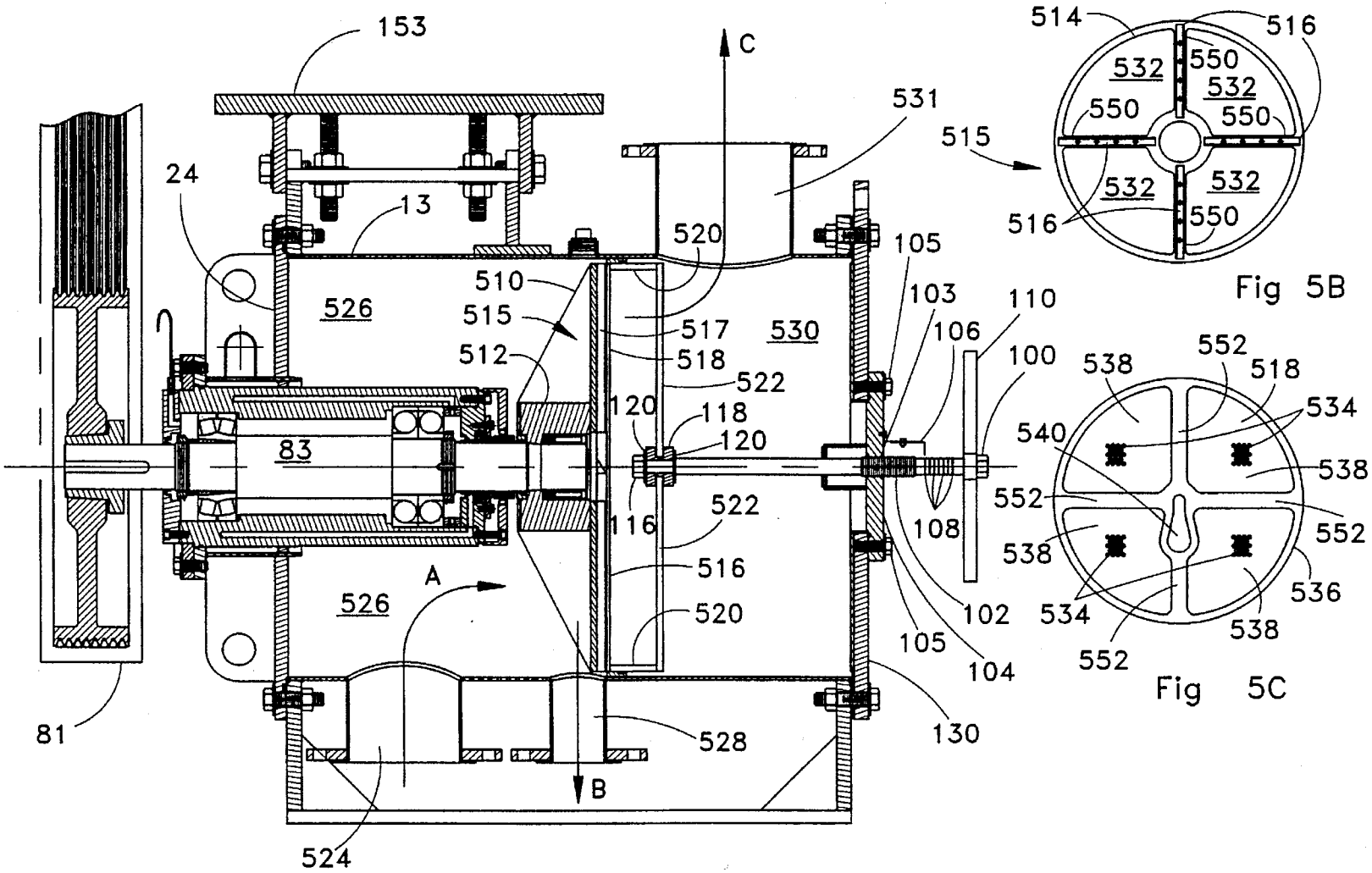
FIG. 5A is a sectional view of a screening apparatus in accordance with the invention, having a flat, diametrical plate that is adjusted forward or backward to control the clearance between it and the flat, diametrical rotor assembly.
FIG. 5B is a front view of a portion of the rotor of the apparatus shown in FIG. 5A.
FIG. 5C is a front view of a portion of the screen plate of the apparatus shown in FIG. 5A.

It will be observed that the invention is not limited to frusto-conical implementations. FIG. 5A is an illustration of an embodiment of the invention in which a planar screen means and a planar circular rotor means are used, with the clearance between the screen means and the circular rotor means adjusted through an axial adjustment means. Both the planar rotor and the planar screen are disposed in a cylindrical interior portion of a housing, and the planes of the rotor and screens are both perpendicular to the axis of the cylindrical interior portion. In other words, the rotor and screen each comprise a parallel plate defining the primary screening region therebetween. As seen in FIG. 5A, a circular rotor 515 is rotated by a shaft and bearing assembly 83 by drive means 81. At least one, and preferably a plurality of blades 516 are provided on rotor 515. Blades 516 are spaced apart from a perforated screen plate 518, thereby forming a primary screening region 517 therebetween. A supporting structure including a spacing means 520 and adjustment support spokes 522 are provided for screen plate 518. This supporting structure is operatively coupled to an adjustment screw 100, which, as in previously described embodiments, provides an adjustment for the spacing between the blades 516 and the screen plate 518 in an axial direction. The rotor 515 may also comprise a plurality of rotor gussets 510 for added strength and for mounting to a shaft mounting means 512. Slurry is introduced, as shown by arrow A, through a stock inlet means 524, into a slurry entry region 526. A sufficient flow of slurry is provided to ensure that only a portion is expelled through rejects port 528 as indicated by arrow B, and that an adequate amount of accepts enters accepts region 530 and exits through accepts port 531, as shown by arrow C.

FIG. 5B shows additional details of the rotor 515 in this embodiment, as it would be seen looking from the right side of FIG. 5A. A circular rim 514 is provided with gaps 532 through which slurry may pass. Portions of rotor gussets 510 (not seen in FIG. 5B) in the preferred rotor configuration also serve as spokes 550 of rotor 515 upon which blades 516 are mounted.

FIG. 5C shows a detail of a preferred perforated screen plate 518 and its associated structures as seen from the right of FIG. 5A. Screen plate 518, which is partially hidden in this view, is provided with suitable perforations 534 (only a portion of which are shown for clarity) through which the accepts portion of the slurry passes. A circular rim 536, which is affixed to or preferably integral with supporting structure 520, is provided with spokes 552 defining a tear-drop-shaped aperture 540 into which thrust ring 120 is mounted. (Note that FIG. 5C shows an equally acceptable alternate mounting configuration to that shown in FIG. 2B for the thrust ring.) Filtered slurry exits through the gaps 538 between the spokes 552.

Although the embodiment shown in FIG. 5A shows slurry being introduced on the rotor side of the screening apparatus, it is also possible to introduce slurry on the screen side, instead. Although such a feeding arrangement for a flat plate embodiment produces very clean pulp, it also tends to have lower capacity than the rotor-side feed arrangement, which utilizes the rotor action to best advantage.

Figures 6A, 6B, 6C:
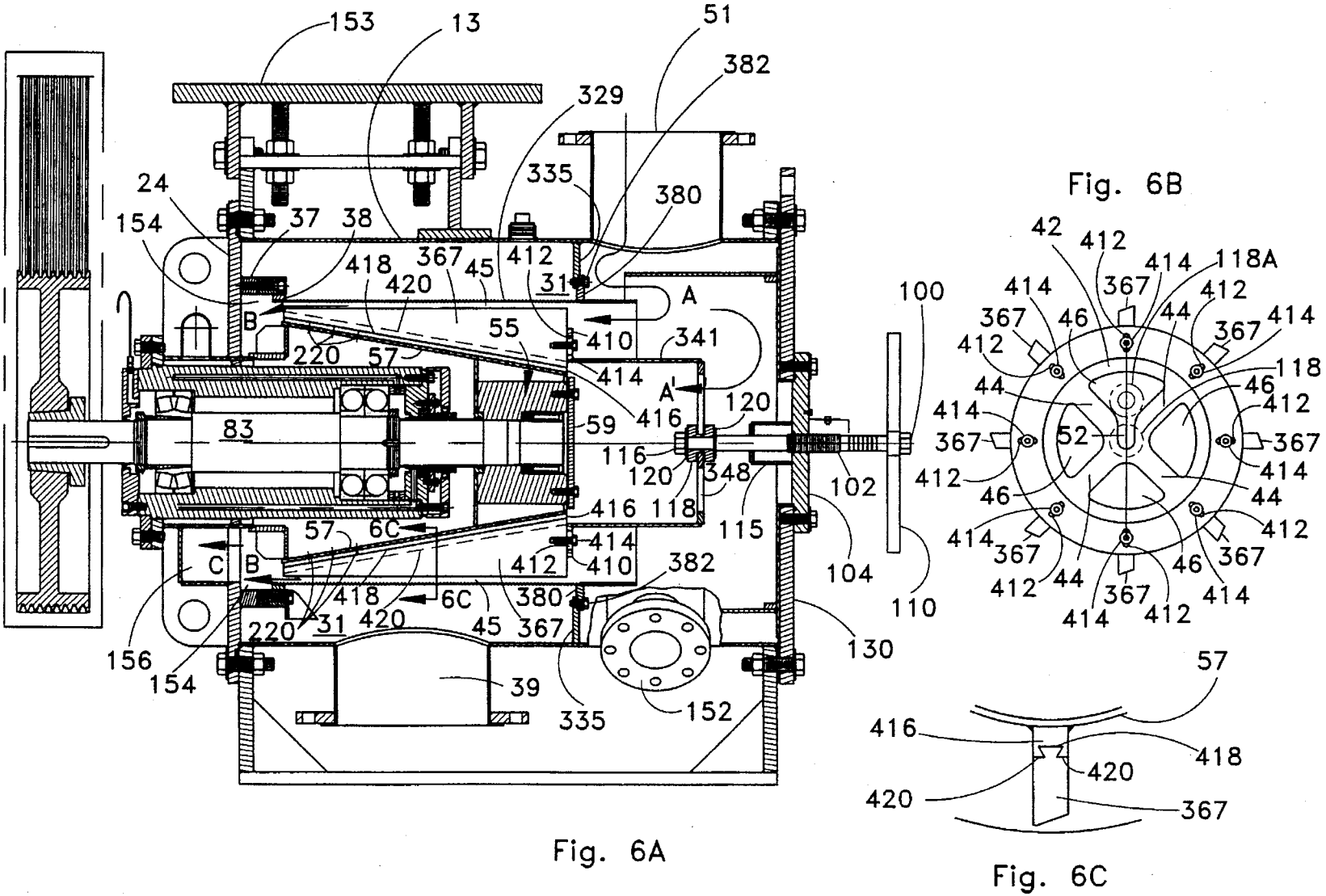
FIG. 6A is a view of an alternate embodiment of the invention having a cylindrical screen and a frusto-conical rotor, in which the distance between the blades and the rotor may be adjusted by a radial adjustment means.
FIG. 6B shows a detail of the end of the rotor and the attachment of both the adjustment means and the blades to the rotor.
FIG. 6C shows a detail of the blade attachment means.

Yet another alternate embodiment of the invention, in which a cylindrical screen rather than a frusto-conical or planar screen is used, is illustrated in FIGS. 6A. Cylindrical screen member 329 may be fixedly held within housing member 13 of this embodiment by means of bolts 382 fixedly attaching flange 380 of the cylindrical screen member 329 to an internal attachment structure 335. An adjustment member 341 preferably having a cylindrical shape is provided for adjusting the clearance between blade members 367 and cylindrical screen member 329 in primary screening zone 45. Adjustment member is provided with an end 348, which is better seen in FIG. 6B. End 348 comprises a continuous, preferably circular rim 42. Spokes 44 radiating from continuous circular rim 42 divide end 348 into a plurality of inlet regions 46, one of which is provided with a slot 52 preferably extending into a central region of end 348. Slot 52 is provided to engage thrust ring 118, which may be inserted as illustrated by phantom outline 118A.

A mounting flange 410 is disposed opposite end 348 of adjustment member 341, as illustrated in FIG. 6A. Mounting flange 410 is provided with at least one, and preferably a plurality of radially elongate mounting apertures 412, which are best seen in FIG. 6B. Blade members 367 are slidably engaged with mounting flange 410 in a radial direction by means of attachment screws 414 through elongate mounting apertures 412 or other suitable means. Referring to FIG. 6A, each of the blade members 367 is also slidably engaged with a corresponding blade engagement structure 416 affixed to frusto-conical wall 57 of rotor body member 55. Blade engagement structures 416 may be seen to better advantage in FIG. 6C, which is an illustration of a section taken along section line 6C in FIG. 6A. As shown in FIG. 6C, each blade engagement structure 416 is joined with a blade member 367 via a sliding dovetail joint comprising walls 418 and 420. Thus, as adjustment screw 100 is rotated, thrust ring 118, which is engaged in slot 52 of end 348, causes an axial translation of mounting flange 410, which causes blade members 367 to ride up or down the inclined dovetail joints joining blade members 367 with blade engagement structures 416, which causes the clearance between blade members 367 and cylindrical screen member 329 to vary as blade members 367 travel along the inclined joints. Blade members 367 are also rotated by the rotary movement of frusto-conical rotor wall 57, causing adjustment member 341 to rotate. The rotation of adjustment member 341 is isolated from adjustment screw 100 by the rotation of slot 52 around thrust ring 118.

Similarly to embodiments described previously, slurry enters through stock inlet means 51 illustrated in FIG. 6A. The slurry can enter primary screening zone 45 directly through an end of cylindrical screen member 329 proximate stock inlet means 51, as shown by arrow A, and/or through inlet regions 46, as shown by arrow A'. In the latter case, the slurry will enter primary screening zone 45 in regions between blade members 367 near mounting flange 410. Rotation of frusto-conical wall 57 imparts motion to the slurry in primary screening zone 45, so that an accepts portion of the slurry passes through apertures in cylindrical screen member 329 into screened zone 31. The accepts portion exits screened zone 31 through accepts outlet means or port 39. Rejects enter reject zone 154, as in the embodiment of FIG. 1.

In each embodiment of the invention, by controlling the clearance between the rotor blades (or other means to transfer motion to the slurry) and the operative portion of the screen means, the pressure and movement of the slurry in the primary screening zone is controlled, and thus throughput rate and accept quality can be controlled. In each embodiment, it will be seen that control of the clearance may be accomplished without stopping the screen to dismantle components, thereby allowing quality and rate to be continuously monitored, and controlled without the necessity to stop production. Blade inventory can be reduced, because the control of quality and rate afforded by the invention allows each blade size and type to perform in a variety of applications, for various slurry types. Furthermore, as blades or screens become worn, and thus, their performance characteristics change, their life can be extended by compensating for the changed characteristics by adjusting the clearance between the screen means and the rotor.

Many modifications and adaptations to the above-described embodiments within the scope of the invention will be apparent to those skilled in the art. Thus, the scope of the invention is not to be considered as limited by the above-described embodiments, but rather should be determined by reference to the claims that follow.

What is claim is:

1. A method for controlling the quality and throughput of an accepts portion of a pulp slurry without stopping a rotor-operated screen used to produce the accepts portion, the method comprising the steps of:

(a) continuously introducing a pulp slurry into a primary screening zone between a rotor impeller and a screen having a clearance therebetween;

(b) operating the rotor to generate regions of disturbance in the pulp slurry within the primary screening zone, so that a portion of the slurry passes through apertures in the screen, thereby becoming the accepts portion;

(c) monitoring at least one portion selected from the group consisting of feed portion, accepts portion, rejects portion, and combinations thereof, to determine at least one parameter selected from the group consisting of accepts throughput rate, accepts dirt content, accepts debris content, reject rate, reject concentration, feed rate, debris level in feed, and combinations thereof, and (d) while continuing to introduce pulp slurry into the primary screening zone, adjusting the clearance between the rotor impeller and the screen so that at least one determined parameter is brought into a desired range.

2. The method of claim 1 wherein the rotor and screen each have coaxial frusto-conical portions defining the primary screening zone therebetween and the adjustment step comprises the step of axially displacing the frusto-conical portions of the rotor and the screen relative to one another.

3. The method of claim 1 wherein the rotor and screen each comprise a parallel plate defining the primary screening zone therebetween and the adjustment step comprises the step of axially displacing the parallel plates relative to one another.

4. A method for controlling the quality of an accepts portion of a pulp slurry without stopping a rotor-operated screen used to produce the accepts portion, the method comprising the steps of:

(a) continuously introducing a pulp slurry into a primary screening zone on a first side of the screen, the screen having an opposite second side and a plurality of apertures therethough;

(b) operating a rotor impeller to cause a portion of the slurry to flow through the apertures in the screen into a region formed between the second side of the screen and the rotor impeller, the portion of the slurry drawn in thereby becoming the accepts portion;

(c) monitoring at least one portion selected from the group consisting of feed portion, accepts portion, rejects portion, and combinations thereof, to determine at least one parameter selected from the group consisting of accepts throughput rate, accepts dirt content, accepts debris content, reject rate, reject concentration, feed rate, debris level in feed, and combinations thereof; and (d) while continuing to introduce pulp slurry into the primary screening zone, adjusting the clearance between the rotor impeller and the screen so that the at least one determined parameter is brought within a desired range.

5. The method of claim 4 wherein the rotor and screen each have coaxial frusto-conical portions defining the primary screening zone therebetween and the adjustment step comprises the step of axially displacing the frusto-conical portions of the rotor and the screen relative to one another.

6. The method of claim 5 wherein the rotor and screen each comprise a parallel plate defining the primary screening zone therebetween and the adjustment step comprises the step of axially displacing the parallel plates relative to one another.

7. The method of claim 4, further comprising the step of introducing a fluid into the region formed between the second side of the screen and the rotor impeller.

* * * * *